US007205514B2

(12) United States Patent
Suzuki et al.

(10) Patent No.: US 7,205,514 B2
(45) Date of Patent: Apr. 17, 2007

(54) HEATING APPARATUS WITH MOVABLE MAGNETIC FLUX ADJUSTING MEANS

(75) Inventors: Hitoshi Suzuki, Matsudo (JP); Naoyuki Yamamoto, Toride (JP); Takahiro Nakase, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,707

(22) Filed: Oct. 21, 2005

(65) Prior Publication Data

US 2006/0086719 A1 Apr. 27, 2006

(30) Foreign Application Priority Data

Oct. 22, 2004 (JP) ..... 2004-308503

(51) Int. Cl.
*H05B 6/14* (2006.01)
*G03G 15/20* (2006.01)

(52) U.S. Cl. ..... 219/619; 219/667; 219/665; 399/328; 399/330

(58) Field of Classification Search ..... 219/619, 219/667, 665, 650, 652; 399/328–338
See application file for complete search history.

(56) References Cited

U.S. PATENT DOCUMENTS

2003/0077093 A1* 4/2003 Sekiguchi ..... 399/328
2005/0006378 A1* 1/2005 Suzuki ..... 219/619

FOREIGN PATENT DOCUMENTS

JP 10-74009 3/1998

* cited by examiner

*Primary Examiner*—Philip H. Leung
(74) *Attorney, Agent, or Firm*—Fitzpatrick, Cella, Harper & Scinto

(57) ABSTRACT

An image heating apparatus has a magnetic flux generator for generating a magnetic flux; a heat generation member for generating heat by the magnetic flux generator; a magnetic flux adjustor for adjusting an effective magnetic flux region toward the heat generation member with respect to a widthwise direction which is perpendicular to a feeding direction of a material to be heated, wherein the material to be heated is heated by heat generation of the heat generation means; wherein the magnetic flux adjustor includes a magnetic flux adjusting member and moving member for moving the magnetic flux adjusting member, and wherein a temperature distribution in theat generation member with respect to the widthwise direction is adjusted by moving the flux adjusting member to a predetermined magnetic flux adjusting position by the moving member; and a discriminator for discriminating whether the effective magnetic flux region corresponds to a size of the material to be heated or not when the magnetic flux adjusting member is at the predetermined magnetic flux adjusting position, wherein a number, per unit time, of materials to be heated which are passed through the heating apparatus is decreased.

4 Claims, 12 Drawing Sheets

HEATING APPARATUS WITH MOVABLE MAGNETIC FLUX ADJUSTING MEANS

FIELD OF THE INVENTION AND RELATED ART

The present invention relates to a heating apparatus of the electromagnetic induction type suitable for image forming apparatuses such as a copying machine, a laser beam printer, etc.

A heating apparatus employing a thermal roller, the heat source of which is a halogen lamp, has long been used as the fixing apparatus to be mounted in an image forming apparatus such as a laser beam printer, a copying machine, etc. In recent years, however, because of the energy conservation movement in the field of office automation devices, a few fixing apparatuses which employ the heating method based on electromagnetic induction have been put to practical use, in place of the widely used fixing apparatuses which employ a thermal roller, the heat source of which is a halogen lamp, for the purpose of conserving energy, as well as reducing a fixing apparatus in the length of time required for startup.

Patent Document 1 discloses one of such fixing apparatuses employing the heating method based on electromagnetic induction. This fixing apparatus comprises a means for generating a magnetic flux, and a heat generating member in which heat is generated by the magnetic flux from the magnetic flux generating means. It thermally fixes the image (which has not been fixed) on recording medium with the heat from the heat generating member.

From the standpoint of energy conservation and quicker startup, the heat generating member is desired to be as small as possible in thermal capacity. Therefore, it is formed of iron, nickel, SUS, or the like, so that it can be rendered as thin as possible while remaining strong. However, this exacerbates the problem that when a recording medium, the size of which is smaller than that of the largest recording medium conveyable through a fixing apparatus, is conveyed through the fixing apparatus, the portions of the fixation roller, which corresponds to the areas outside the path of the recording medium, excessively increases in temperature.

Thus, the fixing apparatus, disclosed in Patent Document 1, which employs the heating method of the electromagnetic induction type, is provided with a magnetic flux adjusting member for partially blocking the magnetic flux which is emitted from the magnetic flux generating means toward the heating member, and a means for moving the magnetic flux adjusting member according to the size and location of the path of a recording medium relative to the heat generating member. In operation, the magnetic flux adjusting member is changed in position by a magnetic flux adjusting member moving means, according to the width and location of the recording medium path relative to the heat generating member, in order to prevent the portions of the heating member, which are outside the path of the recording medium, from excessively increasing in temperature.

Patent Document 1: Japanese Laid-open Patent Application 10-74009.

SUMMARY OF THE INVENTION

However, the above described method for preventing the excessive increase in temperature suffers from the following problem: While multiple recording mediums of a given size (smaller than maximum size) are consecutively fed, the portions of the heat generating member, which are not the portions of the heat generating member shielded from the magnetic flux by the magnetic flux adjusting member, that is, the portions of the heat generating member, which corresponds in position to the path of the recording medium of the given size, remains constant in temperature at the optimum level. However, if recording mediums of a size smaller than the given size are fed immediately after the multiple recording mediums of the given size were consecutively fed, no recording medium is moved through the portion of the heating area between one of the lateral edge of the path of the recording medium of the given size and corresponding lateral edge of the recording medium of the size smaller than the give size. In other words, there is nothing to rob heat from the portion of the heating member, which corresponds in position to this portion of the heating area. Further, the portion of the heat generating member, which corresponds to this portion of heating area, is not shielded from the magnetic flux. Therefore, this portion of the heat generating member excessively increases in temperature.

The present invention was made in consideration of the above described problem, and its primary object is to provide a heating apparatus, which employs the heating method based on electromagnetic induction, and is capable of minimizing the excessive local increase in the temperature of the heat generating member attributable to the difference in size, in terms of the lengthwise direction of the heat generating member, between an object to be heated, and the area in which the heat generating member is subjected to the magnetic flux.

According to an aspect of the present invention, there is provided an image heating apparatus comprising magnetic flux generating means for generating a magnetic flux; a heat generation member for generating heat by the magnetic flux generating means; magnetic flux adjusting means for adjusting an effective magnetic flux region toward said heat generation member with respect to a widthwise direction which is perpendicular to a feeding direction of a material to be heated, wherein the material to be heated is heated by heat generation of said heat generation member; wherein said magnetic flux adjusting means includes a magnetic flux adjusting member and moving means for moving said magnetic flux adjusting member, and wherein a temperature distribution in said heat generation member with respect to the widthwise direction is adjusted by moving said magnetic flux adjusting member to a predetermined magnetic flux adjusting position by said moving means; and discriminating means for discriminating whether the effective magnetic flux region corresponds to a size of the material to be heated or not when said magnetic flux adjusting member is at the predetermined magnetic flux adjusting position, wherein a number, per unit time, of materials to be heated which are passed through said heating apparatus is decreased.

According to the present invention, whether or not the area in which the heat generating member is subjected to the magnetic flux, and the size of which is adjustable by the magnetic flux adjusting member, matches in size an object to be heated, in terms of the direction (width direction) perpendicular to the direction in which an object to be heated is conveyed, is determined by the decision making means, and on the basis of the decision made by the decision making means, the number by which the objects to be heated are conveyed through the heating apparatus per unit of time is reduced. Therefore, it is possible to minimize the excessive local increase in the temperature of the heat generating member attributable to the difference in size between the area in which the heat generating member is subjected to the magnetic flux, and an object to be heated.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

[Embodiment 1]

(1) Example of Image Forming Apparatus

Figure 1:
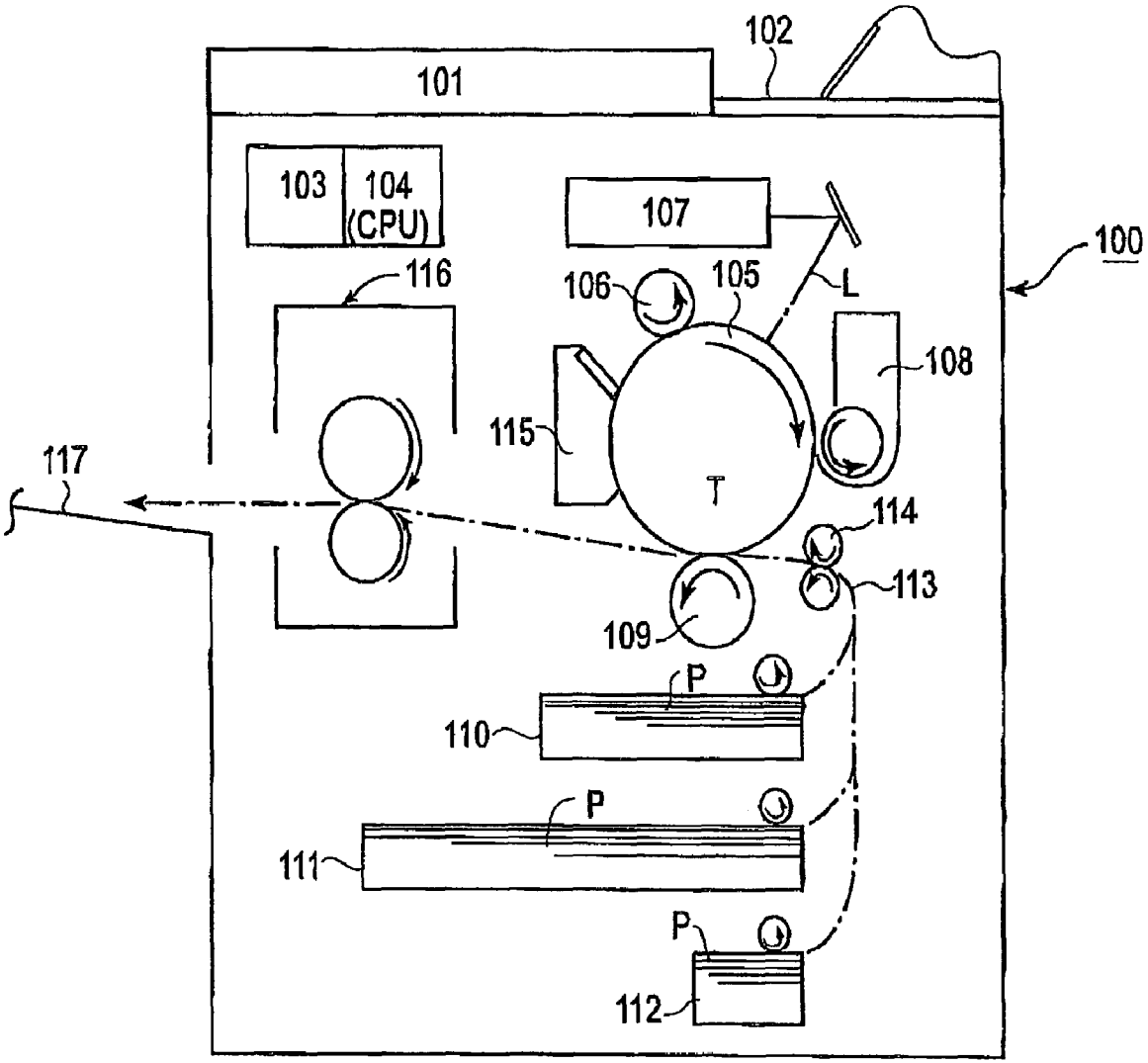
FIG. 1 is a schematic drawing of a typical image forming apparatus, showing the general structure thereof.

FIG. 1 is a schematic drawing of a typical image forming apparatus employing a heating apparatus, as a thermal image fixing apparatus, in accordance with the present invention, which uses the heating method based on electromagnetic induction, showing the general structure thereof. This example of image forming apparatus 100 is a digital image forming apparatus (copying apparatus, printer, facsimileing machine, multifunctional image forming apparatus capable of performing the functions of two or more of preceding examples of image forming apparatuses, etc.) of the transfer type, which uses the electrophotographic process and the exposing method based on laser based scanning.

Designated by referential symbols 101 and 102 are an original reading apparatus (image scanner) and an area designating apparatus (digitizer), respectively, which constitute the top portions of the main assembly of the image forming apparatus 100. The image scanner 101 comprises: an original placement platen; an optical system for illuminating and scanning an original, which has a light source, etc.; a light sensor such as a CCD line sensor; etc. In operation, the surface of an original placed on the original placement platen is scanned to read the light reflected by the surface of the original, by the light sensor, and the thus obtained data of the original are converted into sequential digital electrical signals which correspond to picture elements. The area designating apparatus 102 sets the area of the original, which is to be read, etc., and outputs signals. Designated by a referential symbol 103 is a print controller, which outputs print signals based on the image formation data from a personal computer (unshown) or the like. Designated by a referential symbol 104 is a control portion (CPU) which processes the signals from the image scanner 101, area designating apparatus 102, print controller 103, etc., and sends commands to various portions of the image outputting mechanism. The control portion 104 also controls various image formation sequences.

Described next will be the image outputting mechanism (image forming mechanism). A referential symbol 105 designates an electrophotographic photosensitive member, as an image bearing member, in the form of a rotatable drum (which hereinafter will be referred to simply as photosensitive drum), which is rotationally driven in the clockwise direction indicated by an arrow mark at a predetermined peripheral velocity. As the photosensitive drum 105 is rotated, it is uniformly charged to predetermined polarity and potential level by a charging apparatus 106. The uniformly charged peripheral surface of the photosensitive drum 105 is exposed to a beam of image formation light L projected by an image writing apparatus 107. As the uniformly charged peripheral surface of the photosensitive drum 105 is exposed, numerous exposed points of the uniformly charged peripheral surface of the photosensitive drum 105 reduce in potential level. As a result, an electrostatic latent image, which matches the exposure pattern, is effected on the peripheral surface of the photosensitive drum 105. The image writing apparatus 107 of this example of image forming apparatus is a laser scanner, which outputs a beam of laser light L while modulating it with image formation signals which the control portion 104 (CPU) as a controlling means outputs by processing the image formation data. The uniformly charged peripheral surface of the photosensitive drum 105 is scanned (exposed) by this beam of light L. As a result, an electrostatic latent image reflecting the image formation data obtained from the original is formed.

The electrostatic latent image is developed by a developing apparatus 108 into a visible image formed of toner (which hereinafter will be referred to as toner image). The toner image is electrostatically transferred from the peripheral surface of the photosensitive drum 105 onto a sheet of recording medium P such as paper, OHP film, as an object to be heated, in the transferring portion, that is, the location of a transfer charging apparatus 109, which is where the photosensitive drum 105 and transfer charging apparatus 109 oppose each other, and to which the recording medium P is conveyed, with a predetermined control timing, from the sheet feeding mechanism.

The sheet feeding mechanism of the image forming apparatus in this embodiment is provided with: a first sheet feeding portion 110 employing a cassette in which recording mediums of a small size usable with the apparatus are stored; a second sheet feeding portion 111 employing a cassette in which recording mediums of the largest size usable with the apparatus are stored; a third sheet feeding portion 112 employing a cassette in which recording mediums of the smallest size usable with the apparatus are stored; and a recording medium conveying portion 113 which conveys, with the predetermined timing, to the transferring portion T, each of the recording mediums P fed, while being separated one by one, into the main assembly of the apparatus from the recording medium feeding portion selected from among the recording medium feeding portions 110, 111, and 112. The recording medium conveying portion 113 has a recording medium conveyance roller 114 as a recording medium conveying means, which adjusts the recording medium interval (distance between trailing edge of preceding recording medium and leading edge of trailing one) as it conveys each recording medium P to the transferring portion T, so that a predetermined rate of throughput is maintained.

After a toner image is transferred from the peripheral surface of the photosensitive drum 105 onto the recording medium P in the transferring portion T, the recording medium P is separated from the peripheral surface of the photosensitive drum 105, and is conveyed to a fixing apparatus 116, in which the toner image (which has not been fixed) on the recording medium P is fixed to the recording medium P. After the fixation of the toner image, the recording medium P is discharged into a delivery tray 117 located outside the main assembly of the image forming apparatus.

Meanwhile, the peripheral surface of the photosensitive drum 105 is cleaned, that is, cleared of such adherent contaminants as the toner remaining on the peripheral surface of the photosensitive drum 105, by a cleaning apparatus 115, and then, is used for the next cycle of image formation; the peripheral surface of the photosensitive drum 105 is repeatedly used for image formation.

(2) Fixing Apparatus 116

Figure 2:
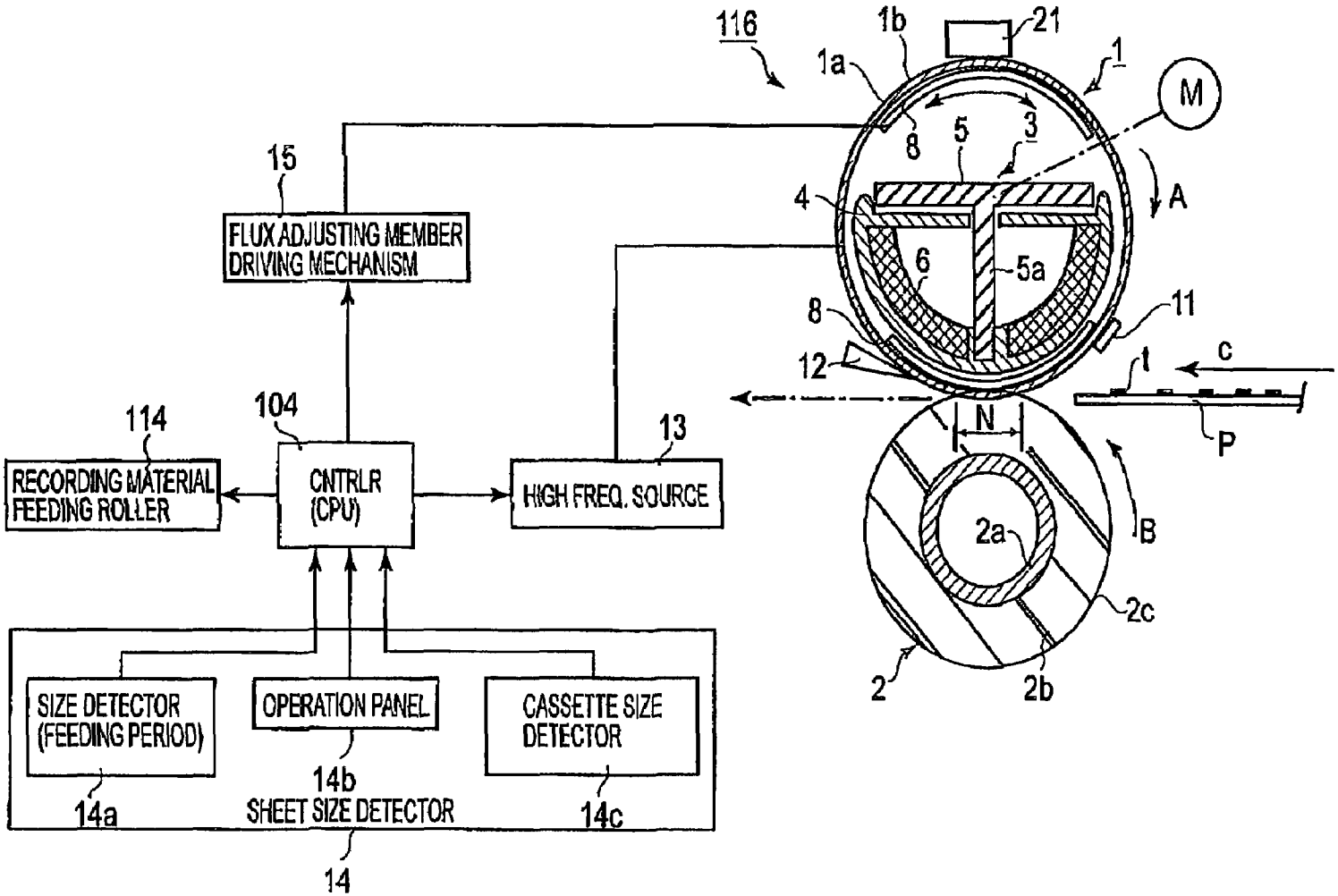
FIG. 2 is a schematic drawing of the first embodiment of a fixing apparatus in accordance with the present invention, showing the general structure thereof.
Figure 3:
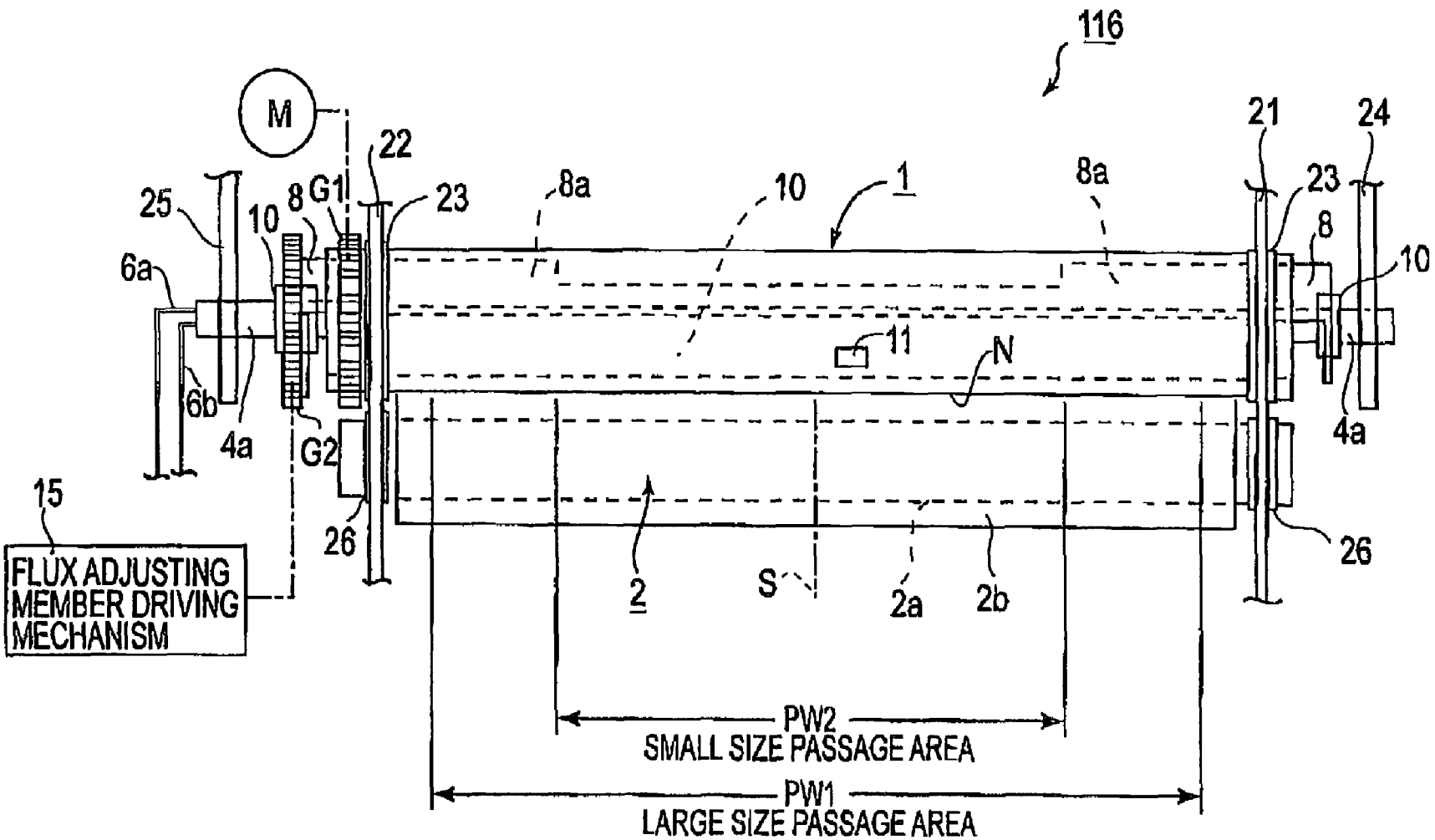
FIG. 3 is a schematic drawing of the first embodiment of a fixing apparatus in accordance with the present invention, as seen from the direction perpendicular to the lengthwise direction of the fixing apparatus, showing the general structure thereof.

FIG. 2 is a schematic drawing of the fixing apparatus 116 in this embodiment, showing the general structure thereof, and FIG. 3 is a drawing of the fixing apparatus shown in FIG. 2, as seen from the direction perpendicular to the lengthwise direction of the fixing apparatus, showing the general structure thereof.

The fixing apparatus 116 in this embodiment is a heating apparatus employing a heat roller and a heating method based on electromagnetic induction. It essentially has a rotatable member 1 (in which heat is generated by electromagnetic induction) as a heating member, and a pressure roller 2 as a pressure applying member. The rotatable member 1 and pressure roller 2 are kept pressed against each other with the application of a predetermined amount of pressure so that a pressure nip N (which may be referred to as fixation nip, heating nip, etc.) with a predetermined dimension (nip width), in terms of the direction in which the recording medium P is conveyed, is formed.

The rotatable member 1 is made up of a metallic core 1*a* (which may be referred to as metallic layer, electrically conductive layer, etc.), and a heat resistant releasing layer 1*b* (which may be referred to as heat conductive member) coated on the peripheral surface of the metallic core 1*a*. The metallic core 1*a* is formed of such substance as Ni, Fe, or SUS, in which heat can be generated by electromagnetic induction. It is cylindrical and hollow, and the thickness of its wall is in the range of 0.02 mm–3.0 mm. The releasing layer 1*b* is formed of fluorinated resin or the like.

The rotatable member 1 (which hereinafter may be referred to as fixation roller) is rotatably supported, at the lengthwise ends, by the first lateral plates 21 and 22 (of fixation unit frame) of the fixing apparatus 116, with the positioning of bearings 23 and 23 between the lengthwise ends of the fixation roller 1 and first lateral plates 21 and 22, one for one. In the hollow of the fixation roller 1, a coil unit 3 as magnetic flux generating means is disposed, which generates high frequency magnetic field for inducing electrical current (eddy current) in the fixation roller 1 to generate heat (Joule heat) in the fixation roller 1.

The pressure roller 2 is made up of a core shaft 2*a*, a heat resistant rubber layer 2*b* formed around the peripheral surface of the core shaft 2*a*, and a heat resistant releasing layer 2*c* formed of fluorinated resin or the like on the peripheral surface of the heat resistant rubber layer 2*b*. The pressure roller 2 is disposed under the fixation roller 1 in parallel to the fixation roller 1. It is rotatably supported between the aforementioned first lateral plates 21 and 22 by the first lateral plates 21 and 22, by the lengthwise ends of the core shaft 2*a*, with bearings 26 and 26 positioned between the lengthwise ends of the core shaft 2*a* and first lateral plates 21 and 22, one for one. Further, the pressure roller 2 is kept pressed on the bottom side of the fixation roller 1 with the application of a predetermined amount of pressure by an unshown pressing means so that a predetermined amount of contact pressure is kept by the resiliency of the heat resistant rubber layer 2*b* between the pressure roller 2 and fixation roller 1, and also, so that a nip N as a heating portion having a predetermined width is formed between the pressure roller 2 and fixation roller 1.

The coil unit 3 is made up of a holder 4, a magnetic core 5 (core member) having the T-shaped cross section and formed of magnetic substance, an exciting coil 6 (source of inductive heat generation), etc. The magnetic core 5 is fitted in the through hole of the holder 4. The exciting coil 6 is formed of copper wire and is wound around the holder 4. The holder 4, magnetic core 5, and exciting coil 6 are integrated, making up the coil unit 3. As for the material for the magnetic core 5, it is desired to be such a substance that is large in permeability and small is internal loss; for example, ferrite, Permalloy, Sendust, amorphous silicon steel, etc. The holder 4 functions as an insulating portion for insulating the magnetic core 5 and exciting coil 6 from each other.

The exciting coil 6 must be capable of generating an alternating magnetic flux strong enough for heating. Thus, it must be lower in electrical resistance and high in inductance. As the core wire of the exciting coil, Litz wire, that is, a predetermined number of strands of fine wires with a predetermined diameter, which are bound together, is used. As the fine wire, electrical wire covered with insulating substance is used. The Litz wire is wound multiple times around the center portion 5*a* of the magnetic core 5, making up the exciting coil 6. Since Litz wire is wound around the portion 5*a* of the magnetic core 5, which is rectangular, the resultant exciting coil 6 has a shape resembling that of a long boat, the lengthwise direction of which is parallel to that of the portion 5*a* of the magnetic core 5. With the employment of this design, the magnetic core 5 is positioned near the center of the exciting coil 6. The lengthwise direction of the exciting coil 6 is parallel to the lengthwise direction of the fixation roller 1. Designated by referential symbols 6*a* and 6*b* are two lead wires (power supplying lines) of the exciting coil 6. They are extended outward of the coil unit 3 through the hollow of one of the cylindrical portions 4*a* of the holder 4, which extend from the lengthwise ends of the holder 4, one for one, and are connected to an exciting coil driving power source 13 for supplying the exciting coil 6 with high frequency electric current.

The coil unit 3 is nonrotatively supported by the second lateral plates 24 and 25 of the fixing apparatus 116, by the lengthwise ends, one for one, so that the holder 4 is held at a predetermined angle, and also, so that a predetermined amount of gap is provided between the internal surface of the fixation roller 1 and exciting coil 6. The coil unit 3 is disposed in the hollow of the fixation roller 1 so that no part of the coil unit 3 is exposed from the fixation roller 1.

As a driving gear G1 attached to one of the lengthwise ends of the fixation roller 1 is rotationally driven by a driving force source M such as a motor, the fixation roller 1 is rotated in the clockwise direction indicated by an arrow mark A. As for the pressure roller 2, it is rotated by the rotation of the fixation roller 1 in the counterclockwise direction indicated by an arrow mark B.

The high frequency electric power source 13 supplies the exciting coil 6 of the coil unit 3 with high frequency electric current (alternating current) in response to the signals from the control portion 104. The coil unit 3 uses the high frequency electric current supplied from the power source 13, to generate a high frequency magnetic field (alternating magnetic flux) which is parallel to the lengthwise direction of the fixation roller 1, and this alternating magnetic flux is guided to the magnetic core 5, inducing thereby eddy current in the portion of the fixation roller 1, which corresponds in position to the aforementioned nip N. This eddy current interacts with the electrical resistance (specific resistivity) of the fixation roller 1, generating thereby heat (Joule heat) in the portion of the fixation roller 1, which corresponds in position to the nip N; in other words, heat is generated in the fixation roller 1 (fixation roller 1 is heated) by electromagnetic induction. Since the fixation roller 1 is rotationally driven, it becomes uniform in surface temperature.

The fixing apparatus 116 is provided with a temperature sensor 11, as a means for detecting the temperature of the fixation roller 11, which is disposed in contact, or virtually in contact, with the peripheral surface of the fixation roller 1 so that it opposes the exciting coil 6 with the presence of the wall of the fixation roller 1 between the temperature sensor 11 and exciting coil 6. The temperature sensor 11 is a thermistor, for example, which detects the temperature of the fixation roller 1, and outputs signals which reflect the detected temperature. These temperature signals are used by the control portion 104 to control the electric power source 13 to regulate the amount of power supply to the exciting coil 6 so that the temperature of the fixation roller 1 remains at a predetermined fixation level (target temperature level). Incidentally, the temperature sensor 11 may be disposed in contact, or virtually in contact, with the internal surface of the fixation roller 1 so that it directly opposes the exciting coil 6.

The fixing apparatus 116 is also provided with a thermostat 21 as a part of a safety mechanism for preventing the fixation roller 1 from abnormally increasing in temperature. The thermostat 21 is disposed in contact, or virtually in contact, with the peripheral surface of the fixation roller 1, and opens its contact portion as the temperature of the fixation roller 1 reaches a predetermined level, in order to cut off the power supply to the exciting coil 6 to prevent the temperature of the fixation roller 1 from exceeding the predetermined level.

While the fixation roller 1 and pressure roller 2 are rotationally driven, the recording medium P bearing the unfixed toner image t which has just been transferred onto the recording medium P is introduced into the fixing apparatus 116 from the direction indicated by an arrow mark C, and fed into the nip N, through which the recording medium P is conveyed while remaining pinched between the fixation roller 1 and pressure roller 2. As the recording medium P is conveyed through the nip N, the heat from the heated fixation roller 1 and the pressure from the pressure roller 2 are applied to the recording medium P and the unfixed toner image t thereon. As a result, the unfixed toner image t is fixed to the recording medium P; a permanent copy is effected. After being conveyed through the nip N, the recording medium P is separated from the fixation roller 1 by a separation claw 12, the tip of which is in contact with the peripheral surface of the fixation roller 1, and is conveyed further leftward in the drawing.

The abovementioned holder 4 and separation claw 12 are formed of heat resistant and electrically insulative engineering plastic.

Designated by a referential symbol 22 is a magnetic flux adjusting means, which has a magnetic flux adjusting member 8 and a mechanism 15, as a moving means, for driving the magnetic flux adjusting member 8. The magnetic flux adjusting member 8 is disposed between the fixation roller 1 and coil unit 3; it is inserted between the fixation roller 1 and coil unit 3. Referring to FIG. 2, the magnetic flux adjusting member 8 in this embodiment extends from one of the lengthwise ends of the coil fixation roller 1 to the other. It is rendered arcuate so that its curvature matches the contour of the exciting coil 6, on the side which faces the internal surface of the fixation roller 1; it extends through the gap between the internal surface of the fixation roller 1 and coil unit 3 without touching either of them. Next, referring to FIG. 3, the holder 4 is provided with the pair of cylindrical portions 4*a*, which extend from the lengthwise ends of the holder 4, one for one, in parallel to the lengthwise direction of the holder 4, and the magnetic flux adjusting member 8 is rotatably supported by the pair of cylindrical portions 4*a*, by the lengthwise ends, with a pair of bearings 10 placed between the lengthwise ends of the magnetic flux adjusting member 8 and the cylindrical portions 4*a*, respectively. In other words, the magnetic flux adjusting member 8 is supported in such a manner that it can be rotated to be placed between the fixation roller 1 and the coil unit 3, that is, the assembly made up of the holder 4, magnetic core 5, exciting coil 6, etc., in the area which corresponds in position to the nip N. As for the material for the magnetic flux adjusting member 8, metallic substances such as Cu, Al, Ag, Au, alloy containing any of the preceding metals, etc., which are electrically conductive and small in specific resistivity, are suitable. As for the shape of the magnetic flux adjusting member 8, the magnetic flux adjusting member 8 is shaped so that the area (range) in which the fixation roller 1 is subjected to the magnetic flux can be regulated in size, in terms of the width direction (lengthwise direction of nip N) perpendicular to the recording medium conveyance direction. In other words, the magnetic flux adjusting member 8 is shaped so that the magnetic flux which is emitted from the coil unit 3 toward the fixation roller 1 can be adjusted in density by the magnetic flux adjusting member 8. The size of the area (range) in which the fixation roller 1 is subjected to the magnetic flux means concerns the lengthwise direction of the magnetic core 5 of the coil unit 3, and it corresponds to the width of the area PW1 (FIG. 4) which corresponds to the path of a recording medium of the largest size usable with the image forming apparatus in this embodiment. The shape of the magnetic flux adjusting member 8 and the mechanism 15 for driving the magnetic flux adjusting member 8 will be described later in more detail.

As for the alignment of a recording medium relative to this embodiment of the present invention, or the fixing apparatus 116, a recording medium is conveyed so that the center line of the recording medium coincides with the center of the nip N in terms of the lengthwise direction of the fixing apparatus 116. Referring to FIG. 3, a referential symbol S designates the center line of the fixation roller 1 (fixing apparatus), as the referential line for aligning a recording medium relative to the fixation roller 1. Here, recording medium size means the dimension of a recording medium, in terms of the direction perpendicular to the recording medium conveyance direction, provided that the recording medium is flat. A referential symbol PW1 designates the area, which corresponds to the path of s recording medium of the largest size usable with the image forming apparatus. In other words, the width of the area PW1 equals the size of a recording medium of the largest size usable with the image forming apparatus. A referential symbols PW2 designates the area, which corresponds to the path of a recording medium of the smallest size usable with the image forming apparatus. In other words, the width of the area PW2 equals the size of a recording medium of the smallest size usable with the image forming apparatus.

Figure 4:
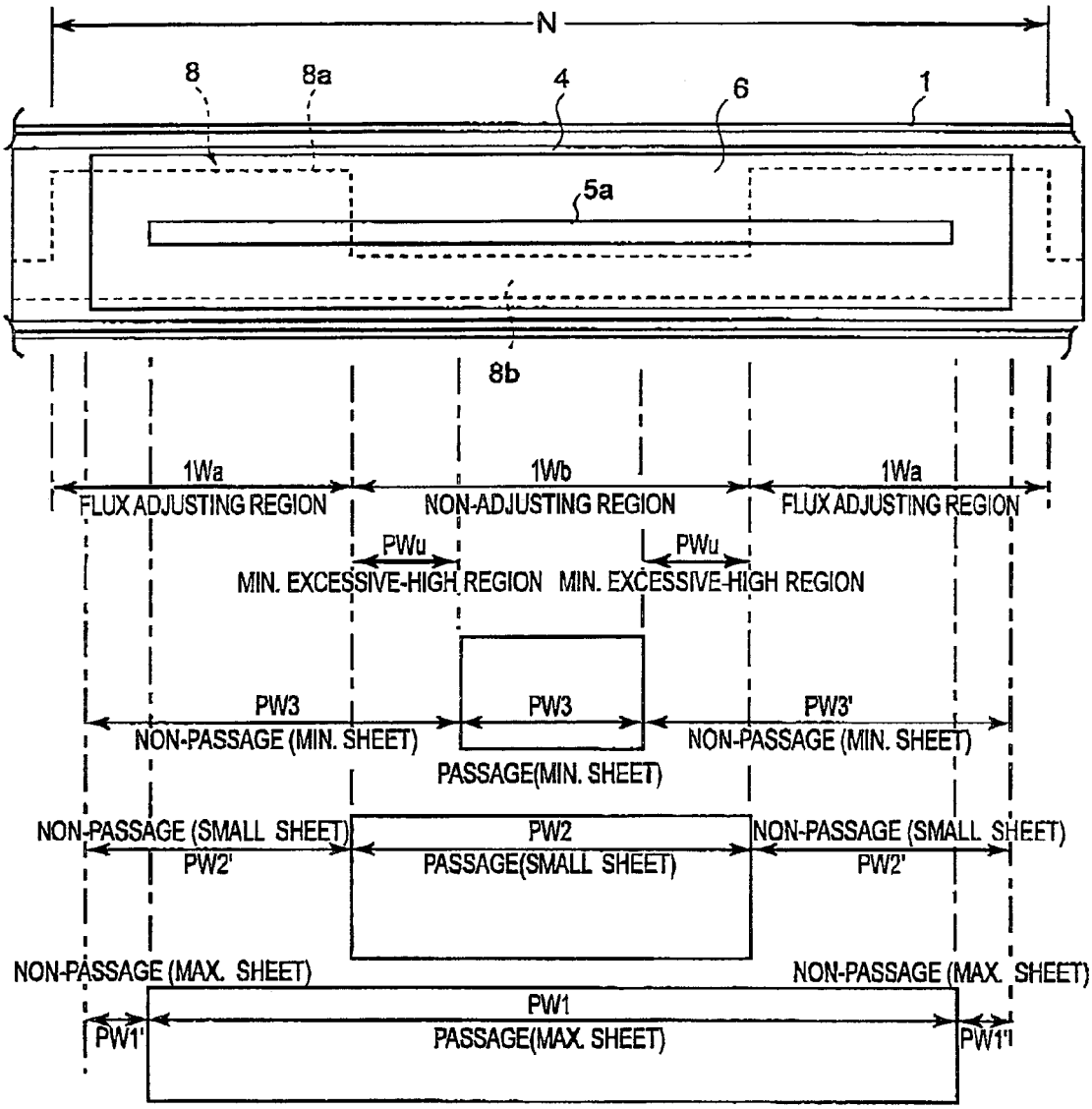
FIG. 4 is a drawing showing the positional relationship among the fixation roller, the paths of various recording mediums different in size, and the areas outside the paths of the various recording mediums.

FIG. 4 shows an example of the shape of the magnetic flux adjusting member 8. FIG. 4 is a drawing showing the positional relationship among the fixation roller 1, the paths of recording mediums different in size, and areas outside the recording medium paths.

The magnetic flux adjusting member 8 is made up of a pair of magnetic flux adjusting portions 8*a* which adjust in density the magnetic flux which is emitted from the coil unit 3 toward the fixation roller 1, and a connective portion 8*b* which connects the pair of magnetic flux adjusting portions 8*a*, and does not adjusts the magnetic flux density. The magnetic flux adjusting portions 8*a* extend toward the lengthwise ends of the fixation roller 1 from the lengthwise ends of the connective portion 8*b*, one for one, in the direction parallel to the axial direction of the fixation roller 1. Each magnetic flux adjusting portion 8*a* is rendered arcuate so that its curvature matches that of the internal surface of the fixation roller 1. The positional relationship between the connective portion 8*b* and magnetic flux adjusting portions 8*a* is made to be such that when the magnetic flux adjusting member 8 is at the magnetic flux adjustment location indicated by a chain line, the connective portion 8*b* is not subjected to the magnetic flux. Further, the connective portion 8*b* is rendered strong enough to hold the magnetic flux adjusting portions 8*a* in parallel to the internal surface of the fixation roller 1, in this fixing apparatus in which a recording medium is conveyed in such a manner that the center line of the recording medium coincides with the center line of the fixation roller 1 in terms of the lengthwise direction of the fixation roller 1. In the case of an image forming apparatus in which a recording medium is conveyed in such a manner that one of the lateral edge of the recording medium remains aligned with the positional referential portion of the fixing apparatus, or the magnetic flux adjusting portions 8*a* do not need to be strong, the connective portion 8*b* is not required. The magnetic flux adjusting portions 8*a* are positioned. The magnetic flux adjusting member 8 is shaped so that when the magnetic flux adjusting member 8 is at the magnetic flux adjustment location, the magnetic flux adjusting portions 8*a* are in the positions in which they adjust the magnetic flux in density. In this embodiment, the distance between the inward edges of the two magnetic flux adjusting portions 8*a* is roughly the same as the size of the area PW2, that is, the size of the path of a recording medium of a small size, for example, A4R, B5R, or the like, which are more frequently used than the recording mediums of the other sizes. As for the distance between the outward edges of the two magnetic flux adjusting portions 8*a*, it is roughly the same as the sum of the size of the area PW1, that is, the size (width) of the path of a recording medium of the largest size usable with the image forming apparatus, for example, a recording medium of size A4 or the like, and the sizes of the areas PW1, that is, the areas outside the path of a recording medium of the largest size usable with the image forming apparatus.

In other words, the magnetic flux adjusting member 8 is movably disposed in the hollow of the fixation roller 1. The magnetic flux adjusting member 8 has a pair of magnetic flux adjusting portions 8*a* for adjusting in steps the size of the area, in terms of the direction perpendicular to the recording medium conveyance direction, in which the magnetic flux is allowed to reach the fixation roller 1. The number of the magnetic flux adjusting portions 8*a* is smaller than the number of the selections of the recording medium usable with the image forming apparatus and different in size (width).

Designated by a referential symbol 23 is a decision making means, which has a size detecting means 14 and a control portion 104. The size detecting means 14 is for detecting the size of the recording medium P. The decision making means 22 is structured so that the control portion 104 determines the size of the recording medium being conveyed through the fixing apparatus, based on the combination of the signals inputted by a user through the control panel having multiple push switches. Incidentally, the decision making means 22 may be structured as follows: The size detecting means 14 is made up of a size detecting means 14*a* for detecting the size of a recording medium while the recording medium is conveyed, a control panel 14*b*, a cassette size detecting means 14*c*, etc. The cassette size detecting means 14*c*, and size detecting means for detecting the size of a recording medium while the recording medium is conveyed, are made up of ultrasonic sensors, etc. Basically, the control portion 104 determines the size of a recording medium based on the signal reflecting one of the predetermined recording medium sizes selected by a user through the control panel. However, for the purpose of preventing errors, in the recording medium size determination, attributable to the errors made by a user while the user is operating the control panel, the placement of wrong recording mediums in any of the sheet feeder cassettes 110, 111, and 112, or the like error, the decision making means 22 may be designed so that the size of a recording medium being conveyed, is determined based on the combination of the signal outputted by the above mentioned sensor disposed in the recording medium conveyance path 112, and the above described signal from the control panel.

The magnetic flux adjusting member driving mechanism 15 is a mechanism for driving (displacement control) the magnetic flux adjusting member 8 in response to the signals from the control portion 104. The driving mechanism 15 is a driving system comprising a motor, etc. As a gear G2 attached to one of the lengthwise ends of the magnetic flux adjusting member 8 is rotationally driven, the magnetic flux adjusting member 8 is rotationally driven in the circumferential direction of the fixation roller 1. As the motor therefor, a stepping motor or the like, for example, is employed.

Next, referring to FIGS. 2 and 4, the operational positions of the magnetic flux adjusting, member 8 will be described. The magnetic flux blocking plate 8 is moved by the magnetic flux adjusting member driving mechanism 15 which is controlled by the control portion 104 in response to the signals from the size detecting means 14; the movement of the magnetic flux blocking plate 8 is controlled by the control portion 104.

As the size detecting means 14 detects the presence of a recording medium of the largest size, the control portion 104 controls the magnetic flux adjusting member driving mechanism 15 so that the magnetic flux blocking plate 8 is rotated into its standby position, in which the magnetic flux blocking plate 8 does not interferes with the high frequency magnetic field (which hereinafter will be referred to as magnetic flux) generated by the coil unit 3, that is, a position in which it is away from the exciting coil 6 (indicated by single-dot chain line in FIG. 2). When the magnetic flux blocking plate 8 is in this position, the magnetic flux emitted by the coil unit 3 toward the fixation roller 1 is not interfered with in density by the magnetic flux blocking plate 8.

On the other hand, as the size detecting means 14 detects a recording medium of the small size, the control portion 104 controls the magnetic flux adjusting means driving mechanism 15 so that the magnetic flux adjusting member 8 is rotated out of the abovementioned standby position into the magnetic flux adjusting position (indicated by solid line in FIG. 2) where the magnetic flux adjusting member 8 opposes the exciting coil 6. When the magnetic flux adjusting member 8 is in this position, the magnetic flux emitted by the coil unit 3 toward the fixation roller 1 is adjusted in density by the magnetic flux adjusting portions 8*a* of the magnetic flux adjusting member 8. In this state, the magnetic flux adjusting portions 8*a* adjust the magnetic flux emitted toward the fixation roller 1, so that the magnetic flux is reduced in density distribution. Thus, the portions of the fixation roller 1, which correspond in position to the magnetic flux adjusting portions 8*a*, one for one, that is, the portions of the fixation roller 1, which correspond in position to the areas PW2, that is, the areas outside the path of the small recording medium, can be reduced in the amount by which heat is generated therein. In other words, the temperature distribution of the fixation roller 1 in terms of the lengthwise direction of the fixation roller 1 can be adjusted. Therefore, when subjecting a recording medium of the small size to the fixation process, the portions of the fixation roller 1, which correspond in position to the magnetic flux adjusting portions 8*a*, that is, the lengthwise portions of the fixation roller 1, which are in the areas 1Wa in which the magnetic flux is adjusted, that is, the portions of the fixation roller 1, which correspond in position to the areas PW2, that is, the areas outside the path of a recording medium of the small size, can be prevented from increasing in temperature.

(3) Essential Cause for Excessive Temperature Increase

Figure 5:
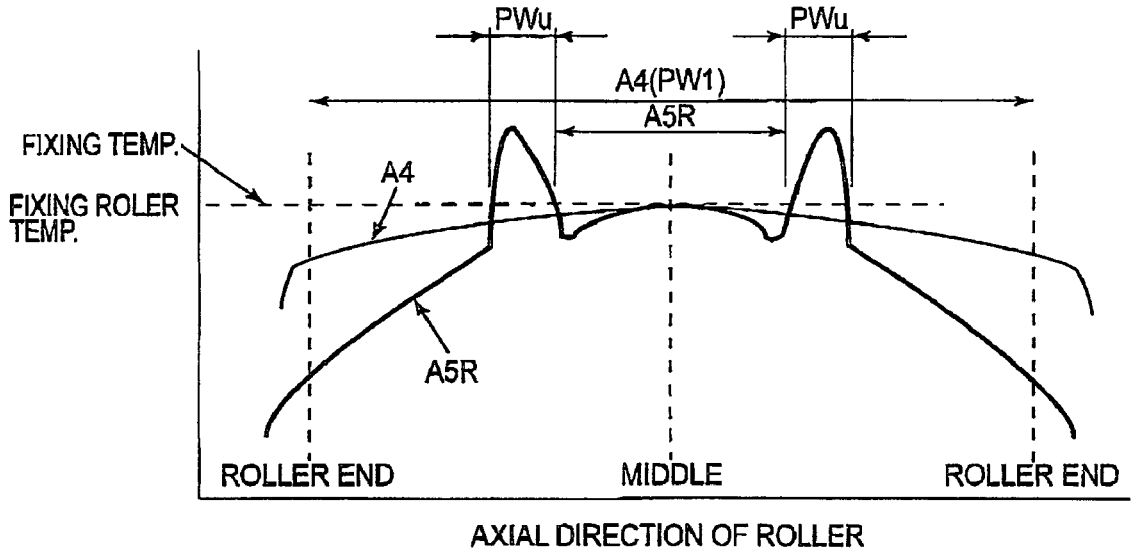
FIG. 5 is a graph showing the temperature distributions of the fixation roller, which correspond, one for one, to while the recording mediums of the largest and smallest sizes are conveyed through the fixing apparatus.

FIG. 5 is a graph showing the temperature distributions of the fixation roller 1, in terms of the width direction (which hereinafter will be referred to as lengthwise direction) of the fixation roller, which occur as recording mediums of the largest and smallest sizes are conveyed through the fixing apparatus. The width of the entire fixation range of the fixation roller 1 equals the width of the path of a recording medium of the largest size, that is, the width of the recording medium of the largest size. Therefore, while the recording mediums of the largest size are conveyed through the fixing apparatus, heat is robbed from the entire fixation range of the fixation roller 1. Therefore, the temperature of the fixation roller 1 falls below the optimum temperature level predetermined for fixation, across the portion corresponding to the area PW1 which corresponds to the path of a recording medium of the largest size (A4); the temperature distribution of the fixation roller 1 becomes as shown in FIG. 5.

On the other hand, as a recording medium of the smallest size, for example, recording medium of A5R size, post card, or the like, is conveyed through the fixing apparatus, areas PW3' through which no recording medium (of smallest size) is conveyed is created outside the area PW3 which corresponds to the path of a recording medium of the smallest size, and it was discovered that as a certain number of recording mediums of the smallest size, such as the abovementioned ones, were conveyed through the fixing apparatus, with the magnetic flux adjusting member 8 located at the magnetic flux adjustment position, the temperature of the fixation roller 1 increased beyond the aforementioned optimum fixation level, across the portion corresponding to the areas PWu which are between the area PW3, and the edges of the area 1Wb in which the magnetic flux was not adjusted, as shown in FIG. 5. This in-between areas PWu in FIG. 5 correspond to the areas PWu in FIG. 4, in which the fixation roller temperature excessively rises as recording mediums of the smallest size are conveyed through the fixing apparatus. This excessive temperature rise occurs for the following reason: The area 1Wb in which magnetic flux is not adjusted by the magnetic flux adjusting portion 8*a* of the magnetic flux adjusting member 8 is improper in size, that is, it does not match in size the area PW3 which corresponds to the path of a recording medium of the small size, creating therefore the areas from which heat is not robbed.

In the case of this embodiment, a statement that the area 1Wb, in which magnetic flux is not adjusted by the magnetic flux adjusting portion 8*a* of the magnetic flux adjusting member 8, is proper in width means that in terms of the direction parallel to the lengthwise direction of the fixation roller 1, the width of the area 1Wb is roughly equal to the width of the recording medium which is being conveyed through the fixing apparatus. Therefore, the statement that the fixation roller 1 excessively increases beyond the predetermined optimum level for fixation includes the case in which the above described in-between area PWu is created within the area 1Wb in which the magnetic flux is not adjusted by the magnetic flux adjusting portion of a magnetic flux adjusting member, even when the magnetic flux adjusting member is enabled to make adjustment in steps.

In reality, however, there are so many types of recording medium different in size, and the magnetic flux adjusting member 8 is required to accommodate all of the recording mediums different in size while ensuring proper fixation. For the purpose of controlling the temperature distribution of the fixation roller 1 with the use of the magnetic flux adjusting member 8, it is possible to shape the magnetic flux adjusting portion 8*a* of the magnetic flux adjusting member 8 so that its magnetic flux controlling edge has steps, or it is angled relative to the axial line of the fixation roller 1. However, such an arrangement makes it complicated to control the movement of the magnetic flux adjusting member 8, and also, makes the magnetic flux adjusting member 8 complicated in shape, being therefore problematic in that the arrangement makes it virtually impossible to dispose the magnetic flux adjusting member 8 in the limited space in the fixation roller 1.

Further, even if it is possible to enable the magnetic flux adjusting member 8 to accommodate all the recording mediums different in size, there still remains a problem. That is, as a certain number of recording mediums of the smallest size are consecutively conveyed through the fixing apparatus, the temperature of the fixation roller 1 becomes excessively low across the lengthwise end portions, causing the temperature distribution of the fixation roller 1 to deviate from the predetermined one. Thus, if a recording medium of the largest size (A4 for example) is conveyed through the fixing apparatus immediately after the consecutive conveyance of a certain number of the smallest size, the problem of fixation failure occurs. As for the solution to this problem, it is possible to give the fixing apparatus a recovery period in which no fixing operation is carried out, that is, to wait until the fixation roller 1 regains the predetermined proper temperature distribution. However, allowing the fixing apparatus the recovery period requires a substantial length of time. Therefore, this solution is nuisance to a user from the standpoint of usability.

(4) Countermeasure for Excessive Temperature Increase

Thus, in this embodiment, the fixing apparatus is designed so that as the recording medium size detecting means 14 detects the presence of a recording medium which is smaller in width than the area 1Wb in which the magnetic flux is not controlled, not only is the magnetic flux adjusting member 8 is moved to the magnetic flux adjustment location, but also, the image forming apparatus (fixing apparatus) is reduced in throughput. Here, reducing the apparatus in throughput means reducing the number by which the recording mediums are conveyed through the nip N per unit of time.

Referring to FIG. 2, the control portion 104 stores the sequence (mode) for preventing the excessive temperature increase. The control portion 104 determines, based on the detection signals from the size detecting means 14, whether or not the detected size of a recording medium is the same as the smallest size. When the detected size of the recording medium equals the smallest size, the control portion 104 controls the driving mechanism 15 so that the magnetic flux adjusting member 8 is moved to the magnetic flux adjustment location, and reduces the throughput by adjusting the recording medium intervals by controlling the recording medium conveyance roller 114.

Figure 6:
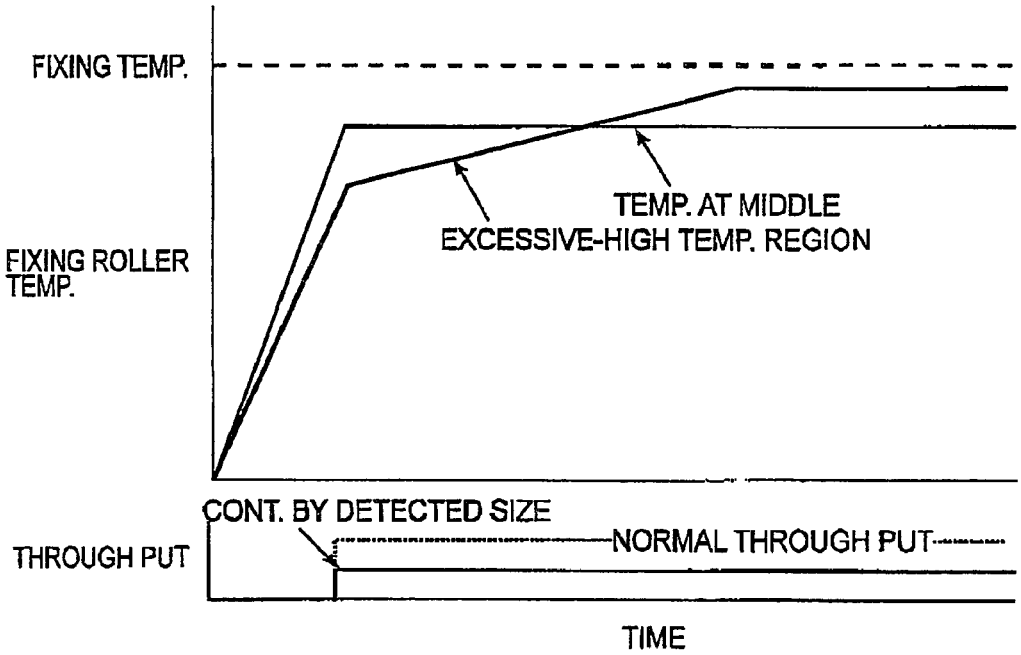
FIG. 6 is a graph showing the chronological changes in the fixation roller temperature, which occurs as the sequence (mode) for preventing the excessive temperature increase is carried out.

FIG. 6 is a drawing showing the chronological changes in the temperature of the fixation roller 1 which occurs as the sequence (mode) for preventing the excessive temperature increase is carried out. As recording mediums of the smallest size, for example, recording mediums of A5R size, post cards, or the like, are conveyed through the fixing apparatus, that is, as the size detecting means detects the presence of a recording medium of the smallest size, the throughput of the image forming apparatus is reduced from the normal level. The reduction in throughput increases the length of time the recording medium (of the smallest size) remains in contact with the fixation roller 1, improving thereby the quality of fixation. Therefore, it is possible to reduce the amount by which electrical power (electrical driving force) is supplied from the electric driving power source 13 to the coil unit 3. With the reduction in the amount by which electrical power is supplied to the coil unit 3, it is possible to keep the temperature of the fixation roller 1 at a level close to the temperature of the mid portion of the area PW3 corresponding to the path of a recording medium of the smallest size, across the portion corresponding to the aforementioned in-between area PWu; it is possible to prevent the temperature of the fixation roller 1 from excessively rising, across the portion corresponding to the area PWu. In other words, with the combination of the use of the magnetic flux adjusting member 8 and reduction in the throughput, it is possible to prevent the portion of the fixation roller 1 corresponding to the in-between area Pwu from excessively increasing in temperature. Therefore, it is possible to ensure satisfactory fixation while reducing the electric power consumption.

[Embodiment 2]

Figure 7:
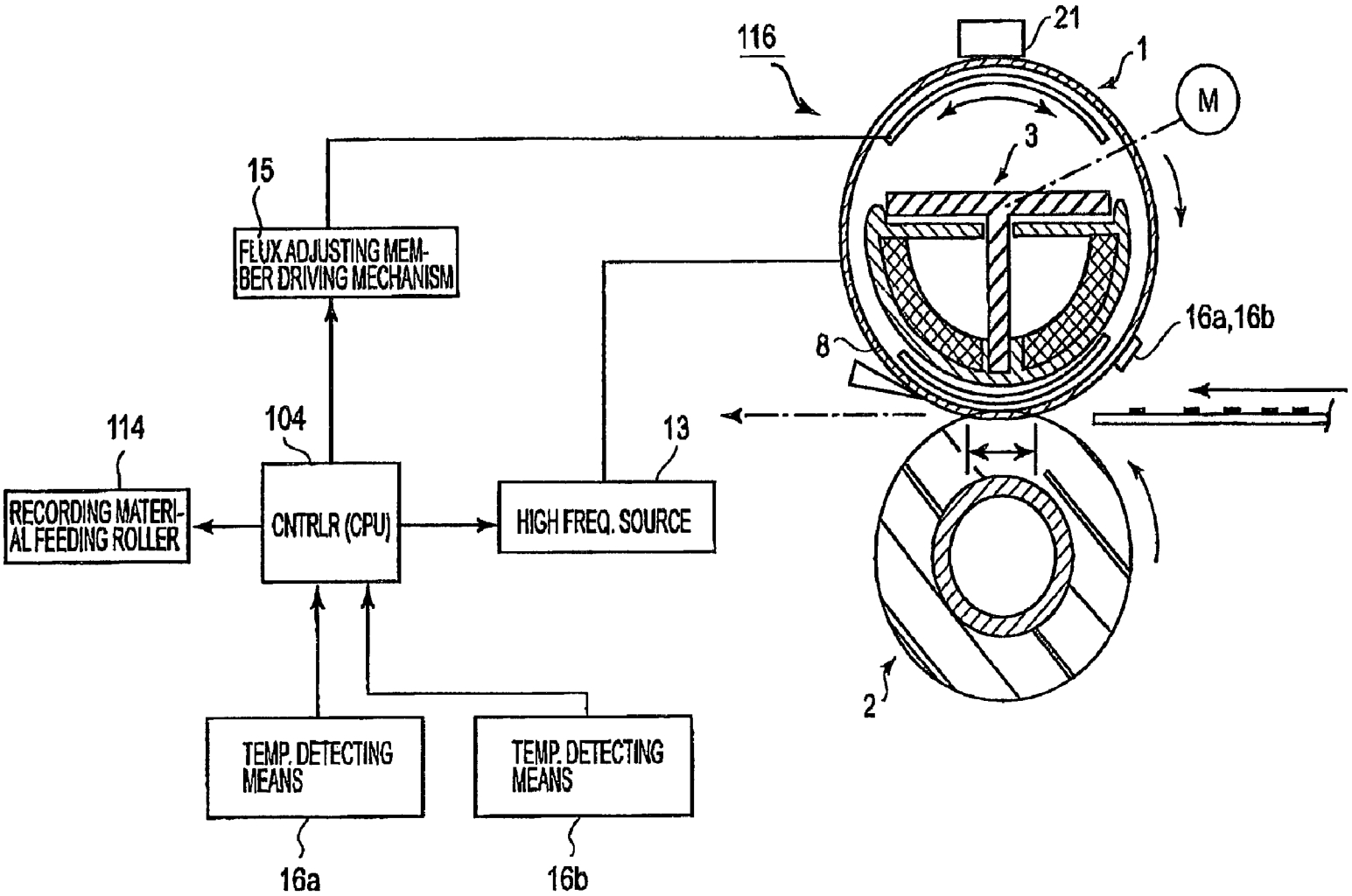
FIG. 7 is a schematic drawing of the second embodiment of a fixing apparatus in accordance with the present invention, showing the general structure thereof.
Figure 8:
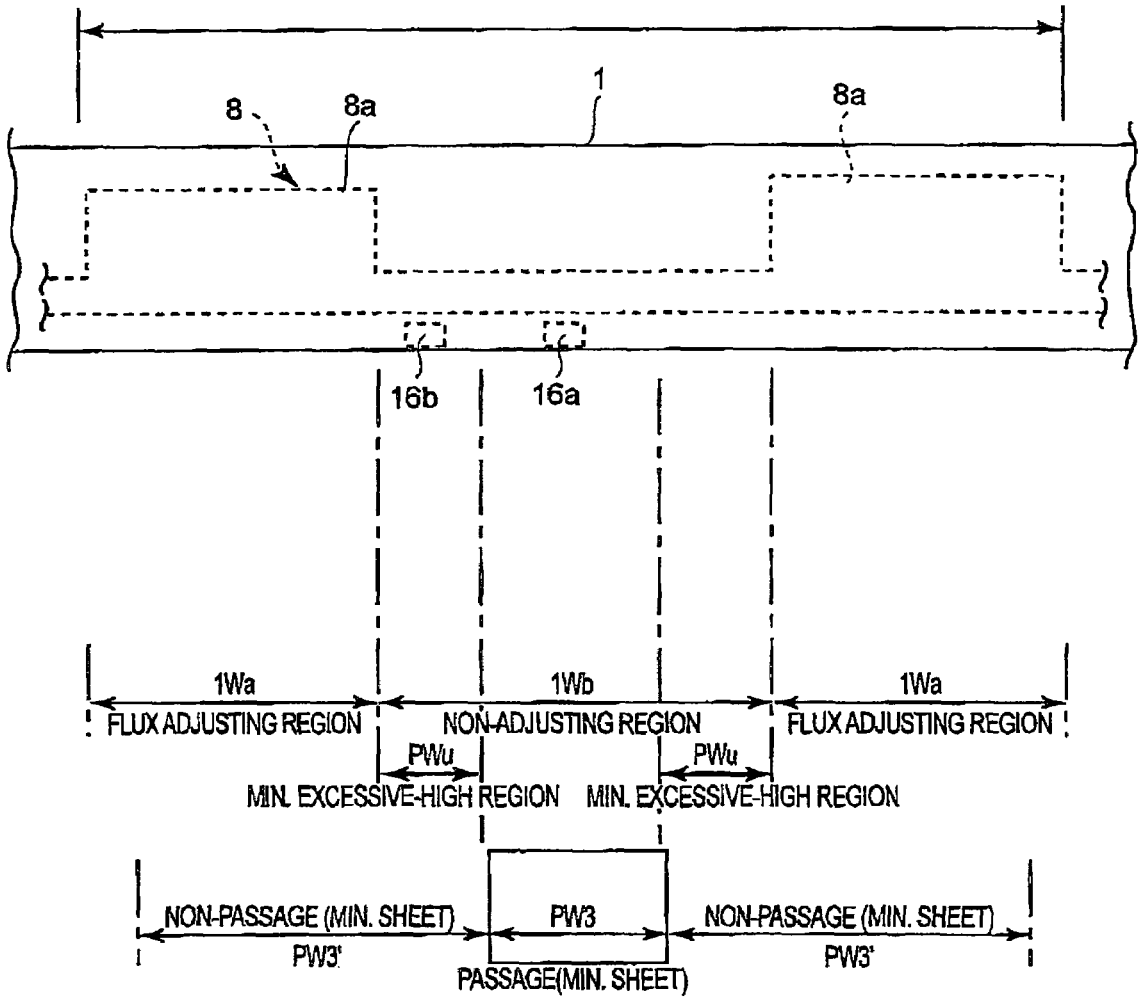
FIG. 8 is a drawing showing the positioning of the temperature detecting means relative to the fixation roller.

This embodiment of the present invention is in the form of another fixing apparatus 116. The decision making means 23 of this fixing apparatus 116 has a temperature detecting means 16*b* and a control portion 104. FIG. 7 is a schematic drawing of the second embodiment of the present invention, or the fixing apparatus 116, showing the general structure thereof, and FIG. 8 is a drawing showing the position of the temperature detecting means 16*b* relative to the fixation roller 1.

The fixing apparatus 116 is provided with two temperature detecting means 16*a* and 16*b*. The temperature detecting means 16*a* is disposed in contact, or virtually in contact, with the peripheral surface of the fixation roller 1, in the area PW3 corresponding to the path of a recording medium of the smallest size, whereas the other temperature detecting means, or the temperature detecting means 16*b*, is disposed in contact, or virtually in contact, with the peripheral surface of the fixation roller 1, in the area PWu in which the temperature of the fixation roller 1 excessively increases as recording mediums of the smallest size are consecutively conveyed through the fixing apparatus. The temperature detecting means 16*a* is used for controlling the fixing apparatus in temperature during a normal operation. The temperature detecting means 16*b* is used for controlling the fixing apparatus when reducing the throughput. As the temperature detecting means 16*a* and 16*b*, a thermistor, a thermopile, a thermocouple, or the like is employed as fits.

As for the countermeasure for the excessive temperature increase in this embodiment, the temperature of the fixation roller 1 in the in-between area PWu in which the temperature of the fixation roller 1 tends to excessively rises as recording mediums of the smallest size are consecutively conveyed through the fixing apparatus, is detected by the temperature detecting means 16*b*, and based on the detected temperature level, the magnetic flux adjusting member 8 is moved to the magnetic flux adjustment location and the fixing apparatus (image forming apparatus) is reduced in throughput. The control portion 104 stores the sequence (mode) for preventing the excessive temperature increase. The control portion 104 determines whether or not the temperature level detected by the temperature detecting means 16*b* has reached a predetermined referential level, on the basis of the detection signal it receives from the temperature detecting means 16*b*. When it determines that the detected temperature level has reached the referential level, it controls the driving mechanism 15 to move the magnetic flux adjusting member 8 to the magnetic flux adjustment location, and controls the recording medium conveyance roller 114 to reduce the fixing apparatus in throughput by adjusting the recording medium intervals.

Figure 9:
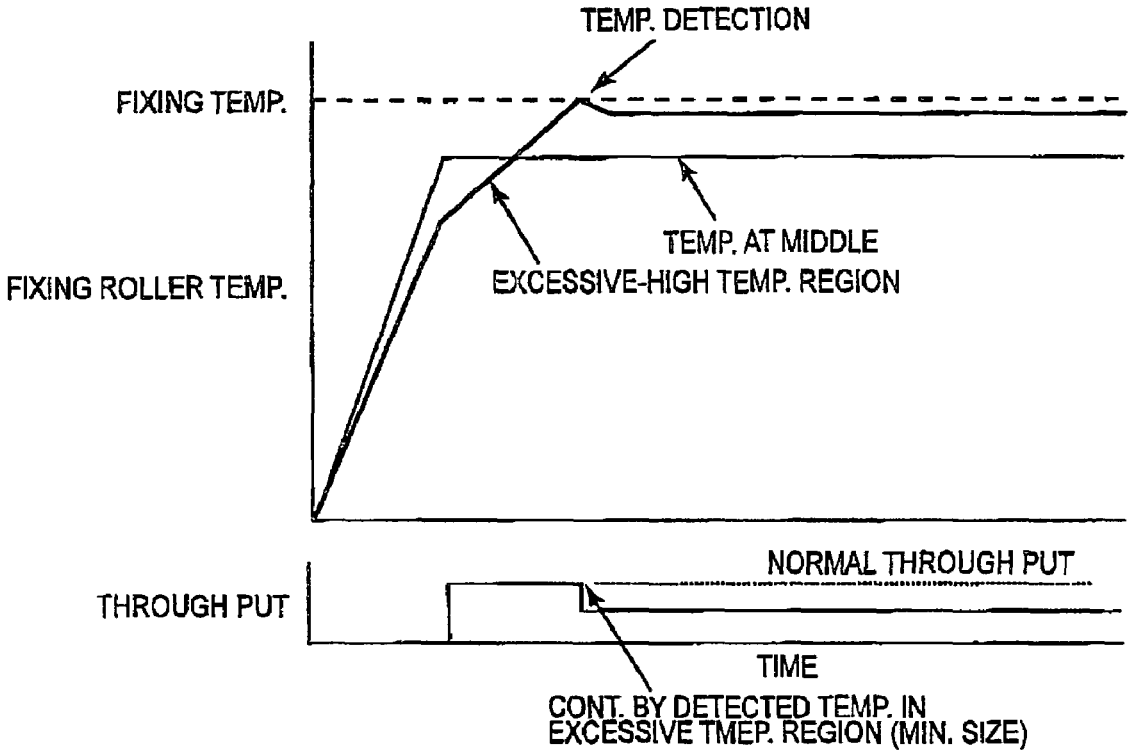
FIG. 9 is a graph showing the chronological changes in the fixation roller temperature, which occurs as the sequence (mode) for preventing the excessive temperature increase is carried out.

FIG. 9 is a drawing showing the chronological changes in the temperature of the fixation roller 1 which occurs as the sequence (mode) for preventing the excessive temperature increase is carried out. As recording mediums of the smallest size, for example, recording mediums of A5R size, post cards, or the like, are consecutively conveyed through the fixing apparatus, that is, as the abovementioned decision is made on the basis of the temperature of the fixation roller 1 in the in-between area PWu in which the temperature of the fixation roller 1 tends to excessively increases as recording mediums of the smallest size are consecutively conveyed through the fixing apparatus, the fixing apparatus is reduced in throughput from the normal level. With the employment of this countermeasure, the image forming apparatus does not need to be reduced in throughput until the temperature of the portion of the fixation roller 1 in the in-between area PWu reaches the referential level. Therefore, this embodiment is superior in terms of usability.

Like the first embodiment of the present invention, this embodiment can keep the temperature of the fixation roller 1 at a level close to the temperature level of the fixation roller 1 corresponding the mid portion of the area PW3 which corresponds to the path of a recording medium of the smallest size, across the portion corresponding to the aforementioned in-between area PWu; it is possible to prevent the temperature of the portion of the fixation roller 1 corresponding to the in-between area PWu from excessively increasing. In other words, with the combination of the use of the magnetic flux adjusting member 8 and reduction in the throughput, it is possible to prevent the portion of the fixation roller 1 corresponding to the in-between area PWu from excessively increasing in temperature. Therefore, it is possible to ensure satisfactory fixation while reducing the electric power consumption.

[Embodiment 3]

Figure 10:
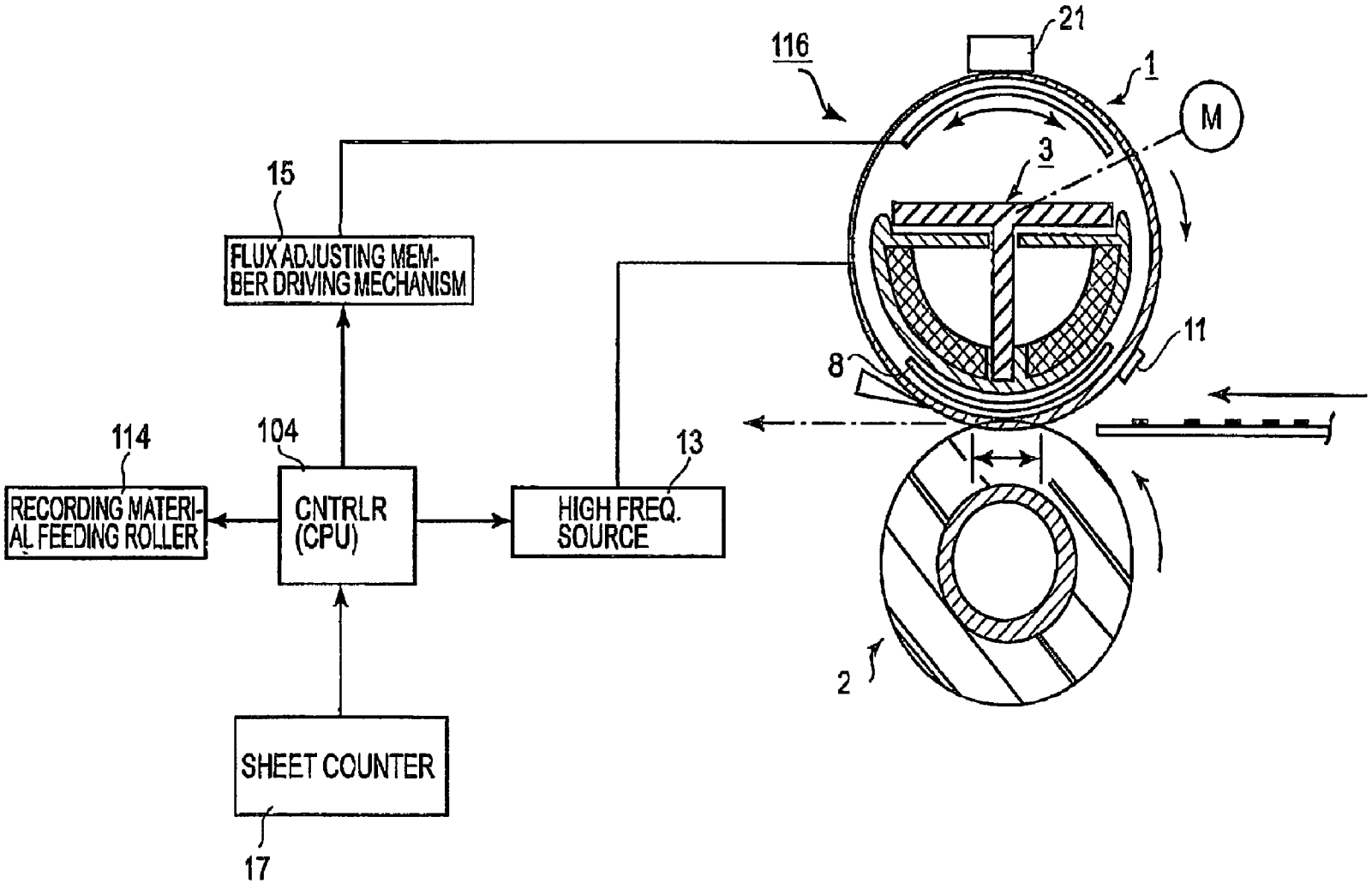
FIG. 10 is a schematic drawing of the third embodiment of a fixing apparatus in accordance with the present invention, showing the general structure thereof.

This embodiment of the present invention is in the form of another fixing apparatus 116. The decision making means 23 of this fixing apparatus 116 has a recording medium count detecting means 17 and a control portion 104. FIG. 10 is a schematic drawing of the fixing apparatus 116, or the third embodiment of the present invention, showing the general structure thereof.

The recording medium count detecting means 17 has only to be capable of detecting the number of the recording mediums of the smallest size conveyed through the fixing apparatus 116. As the recording medium count detecting means 17, a widely used means such as a flag sensor, a control panel through which print count can be inputted, or the like may be employed as fits.

As for the countermeasure in this embodiment for the excessive temperature increase, the number of the recording mediums of the smallest size is detected by the recording medium count detecting means 17, and based on the detected number, the magnetic flux adjusting member 8 is moved to the magnetic flux adjustment location and the fixing apparatus (image forming apparatus) is reduced in throughput. The control portion 104 stores the sequence (mode) for preventing the excessive temperature increase. The control portion 104 determines whether or not the detected number has exceeded a predetermined limit, on the basis of the signal reflecting the detected number it receives from the recording medium count detecting means 17. The predetermined numerical limit corresponds to the empirically obtained number by which recording mediums of the smallest size can be conveyed through the area 1Wb in which magnetic flux is not controlled by the magnetic flux adjusting member 8, before the portion of the fixation roller 1 corresponding to the area PWu exceeds the predetermined temperature limit. As the control portion 104 determines that the detected count has exceeded the recording medium count limit, it controls the driving mechanism 15 to move the magnetic flux adjusting member 8 to the magnetic flux adjustment location, and controls the recording medium conveyance roller 114 to reduce the fixing apparatus in throughput by adjusting the recording medium intervals.

Figure 11:
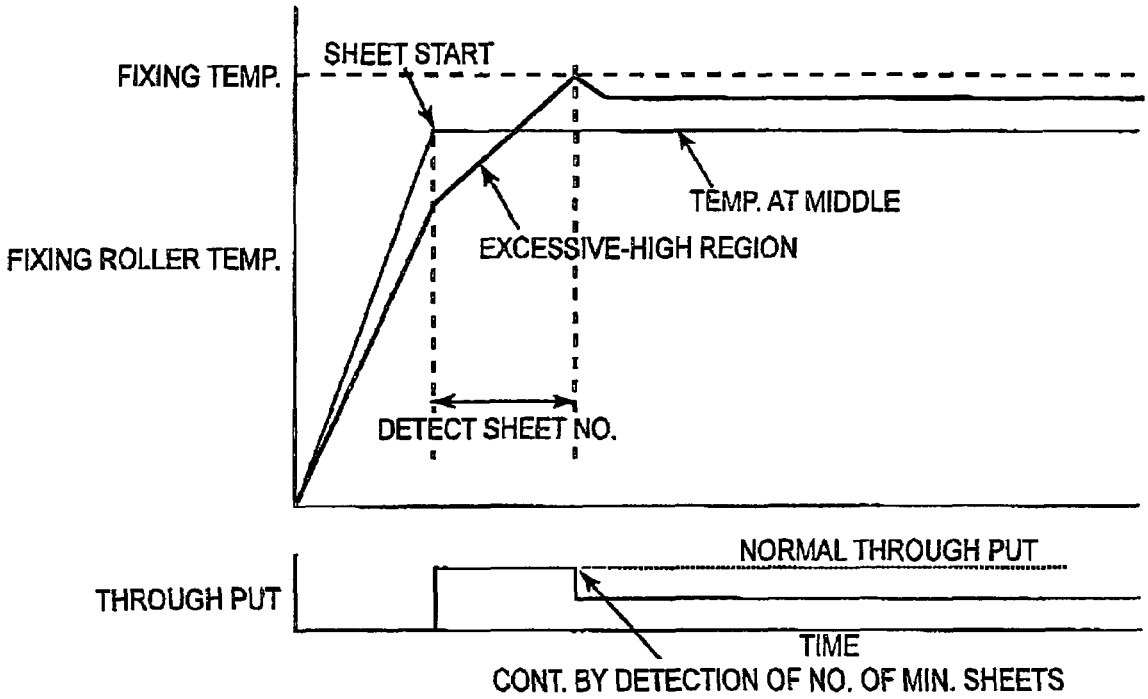
FIG. 11 is a graph showing the chronological changes in the fixation roller temperature, which occurs as the sequence (mode) for preventing the excessive temperature increase is carried out.

FIG. 11 is a drawing showing the chronological changes in the temperature of the fixation roller 1 which occurs as the sequence (mode) for preventing the excessive temperature increase is carried out. As recording mediums of the smallest size, for example, recording mediums of A5R size, post cards, or the like, are consecutively conveyed through the fixing apparatus, that is, as the abovementioned decision is made on the basis of the number of the recording mediums of the smallest size detected by the recording medium count detecting means 17, the fixing apparatus is reduced in throughput from the normal level. In the case of this embodiment, when the recording sheets of A5R size, for example, are used as the recording mediums, it was possible to consecutively convey roughly 30 recording sheets. With the employment of this countermeasure, therefore, the image forming apparatus does not need to be reduced in throughput until the number of the recording mediums of the smallest size conveyed through the fixing apparatus reaches the empirically obtained number. Therefore, this embodiment is superior in terms of usability.

Like the first embodiment of the present invention, this embodiment can keep the temperature of the fixation roller 1 at a level close to the temperature level of the portion of the fixation roller 1 corresponding to the mid portion of the area PW3 which corresponds to the path of a recording medium of the smallest size, across the portion corresponding to the aforementioned in-between area PWu; it is possible to prevent the temperature of the portion of the fixation roller 1 corresponding to the in-between area PWu from excessively increasing. In other words, with the combination of the use of the magnetic flux adjusting member 8 and reduction in the throughput, it is possible to prevent the portion of the fixation roller 1 corresponding to the in-between area PWu from excessively increasing in temperature. Therefore, it is possible to ensure satisfactory fixation while reducing the electric power consumption.

[Embodiment 4]

Figure 12:
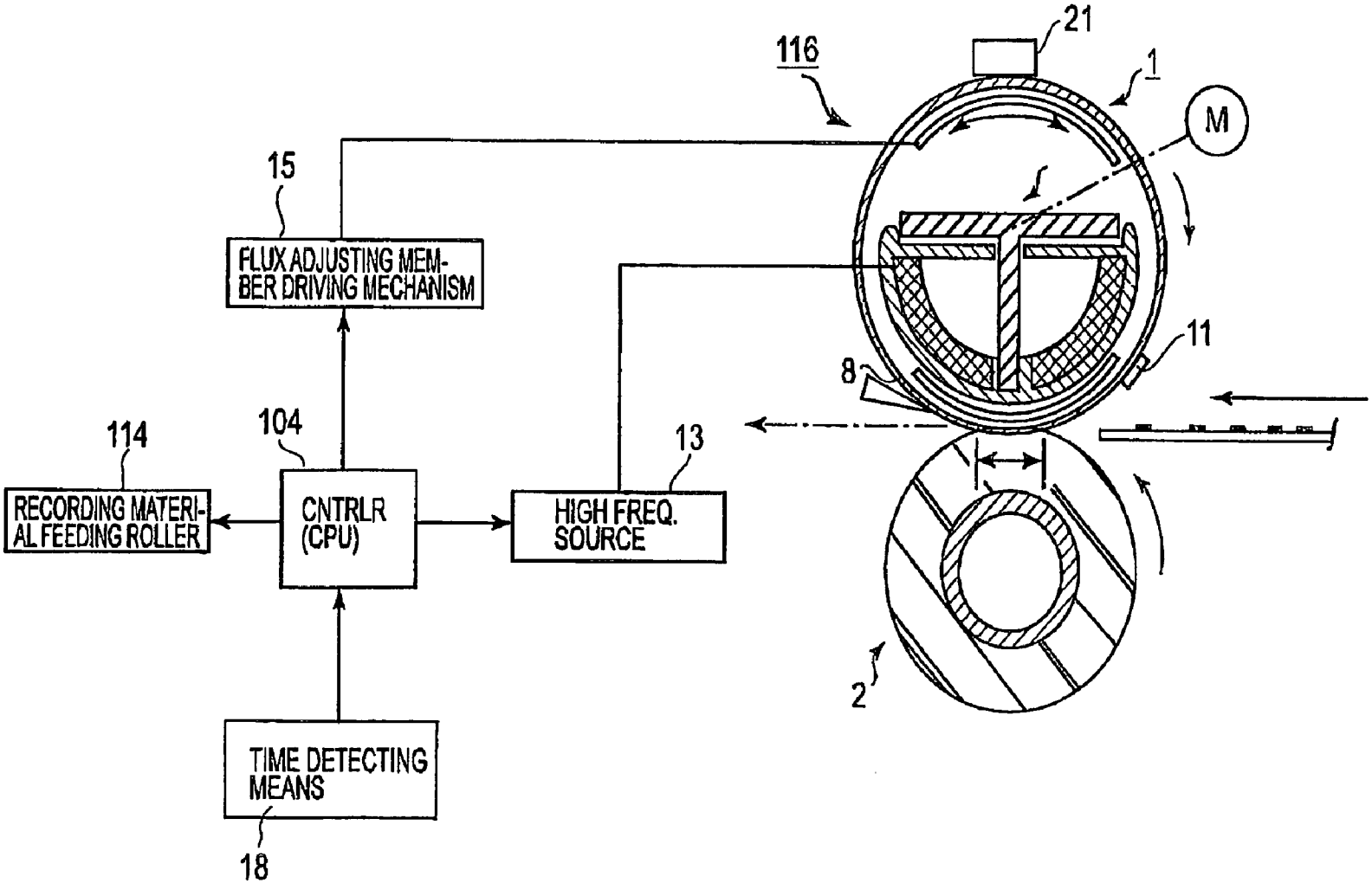
FIG. 12 is a schematic drawing of the fourth embodiment of a fixing apparatus in accordance with the present invention, showing the general structure thereof.

This embodiment of the present invention is in the form of yet another fixing apparatus 116. The decision making means 23 of this fixing apparatus 116 has a time detecting means 18 and a control portion 104. FIG. 12 is a schematic drawing of the fixing apparatus 116, or the fourth embodiment of the present invention, showing the general structure thereof.

The time detecting means 18 has only to be capable of measuring the length of time (conveyance time) recording mediums of the smallest size can be consecutively conveyed through the fixing apparatus 116. As the time detecting means 18, a widely used means such as an ordinary timer or the like may be employed as fits.

As for the countermeasure in this embodiment for the excessive temperature increase, the length of time the recording mediums of the smallest size can be consecutively conveyed through the fixing apparatus is detected by the time detecting means 18, and based on the detected length of time, the magnetic flux adjusting member 8 is moved to the magnetic flux adjustment location and the fixing apparatus (image forming apparatus) is reduced in throughput. The control portion 104 stores the sequence (mode) for preventing the excessive temperature increase. The control portion 104 determines whether or not the detected length of time has exceeded a predetermined limit, on the basis of the signal reflecting the detected length of time, which it receives from the time detecting means 18. The predetermined limit in the length of time recording mediums of the smallest size are allowed to be conveyed corresponds to the empirically obtained length of time recording mediums of the smallest size can be conveyed through the area 1Wb in which the magnetic flux is not adjusted, before the temperature of the portion of the fixation roller 1 corresponding to the in-between area PWu, in which the fixation roller temperature tends to excessively increases as recording mediums of the smallest size are consecutively conveyed through the fixing apparatus. As the control portion 104 determines that the detected length of time has exceeded the predetermined limit, it controls the driving mechanism 15 to move the magnetic flux adjusting member 8 to the magnetic flux adjustment location, and controls the recording medium conveyance roller 114 to reduce the fixing apparatus in throughput by adjusting the recording medium intervals.

Figure 13:
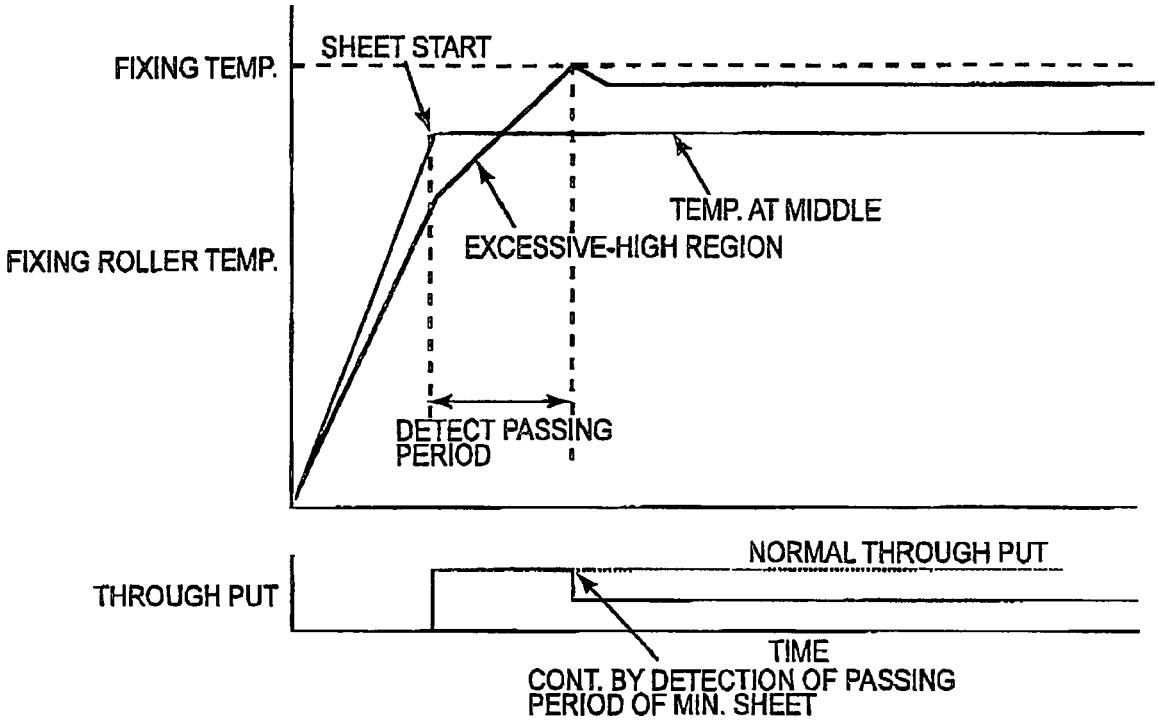
FIG. 13 is a graph showing the chronological changes in the fixation roller temperature, which occurs as the sequence (mode) for preventing the excessive temperature increase is carried out.

FIG. 13 is a drawing showing the chronological changes in the temperature of the fixation roller 1 which occurs as the sequence (mode) for preventing the excessive temperature increase is carried out. As recording mediums of the smallest size, for example, recording mediums of A5R size, post cards, or the like, are conveyed through the fixing apparatus, that is, as the abovementioned decision is made on the basis of the length of time (detected by time detecting means 18) recording mediums of the smallest size were consecutively conveyed through the fixing apparatus, the fixing apparatus is reduced in throughput from the normal level. In the case of this embodiment, when the recording sheets of A5R size, for example, were used as the recording mediums, it was possible to consecutively convey the recording mediums for roughly 30 seconds. With the employment of this countermeasure, therefore, the image forming apparatus does not need to be reduced in throughput until the length of time recording mediums of the smallest size are conveyed through the fixing apparatus reaches the empirically obtained value. Therefore, this embodiment is superior in terms of usability.

Like the first embodiment of the present invention, this embodiment can keep the temperature of the fixation roller 1 at a level close to the temperature of the portion of the fixation roller 1 corresponding to the mid point of the area PW3 which corresponds to the path of a recording medium of the smallest size, across the portion corresponding to the aforementioned in-between area PWu; it is possible to prevent the temperature of the portion of the fixation roller 1 corresponding to the in-between area PWu from excessively increasing. In other words, with the combination of the use of the magnetic flux adjusting member 8 and reduction in the throughput, it is possible to prevent the portion of the fixation roller 1 corresponding to the in-between area PWu from excessively increasing in temperature. Therefore, it is possible to ensure satisfactory fixation while reducing the electric power consumption.

[Miscellanies]

1) In the preceding embodiments, the temperature distribution of the fixation roller 1 in terms of the lengthwise direction of the fixation roller 1 was adjusted by adjusting the magnetic flux in the areas PW2' which are outside the path of a recording medium of a small size, with the use of the magnetic flux adjusting portion 8*a* of the magnetic flux adjusting member 8. However, the choice of the magnetic flux adjusting member does not need to be limited to those in the preceding embodiments; any magnetic flux adjusting member will suffice as long as it can adjust the temperature distribution of the fixation roller 1 in terms of the lengthwise direction of the fixation roller 1. For example, instead of those in the preceding embodiments, a magnetic flux adjusting member, the magnetic flux adjusting portion of which correspond in position to the area PW2 (FIG. 4: center portion of fixation roller) which corresponds to the path of a recording medium of the small size, may be employed. In such a case, the magnetic flux adjusting member is displaced relative to the exciting coil of the coil unit so that the magnetic flux distribution in terms of the lengthwise direction of the fixation roller is relatively varied by the magnetic flux adjusting portion of the magnetic flux adjusting member, in order to adjust the temperature distribution of the fixation roller in terms of the lengthwise direction thereof.

2) The usage of the heating apparatus, in accordance with the present invention, which employs the heating method based on electromagnetic induction, is not limited to the usage as the thermal fixing apparatus for an image forming apparatus like the preceding embodiments. For example, it is effective as such an image heating apparatus as a fixing apparatus for temporarily fixing an unfixed image to a sheet of recording paper, a surface property changing apparatus for reheating a sheet of recording paper bearing a fixed image to change the sheet of recording medium in surface properties, such as glossiness. Obviously, it is also effectively usable as a thermal pressing apparatus for removing wrinkles from a paper money or the like, a thermal laminating apparatus, a thermal drying apparatus for causing the water content in paper or the like to evaporate, a heating apparatus for thermally processing an object in the form of a sheet, and the like apparatuses.

3) The heating generating member does not need to be in the form of a roller; it may be in the form of any rotatable member, such as an endless belt. Further, the heat generating member based on electromagnetic induction may be formed in a single piece, or may be formed as a compound member having two or more layers, that is, a layer of heat resistant resin, ceramic, or the like, in addition to the layer of a substance in which heat can be generated by electromagnetic induction.

4) The structural arrangement for generating heat in the heat generating member by electromagnetic induction with the use of the magnetic flux generating member does not need to be limited to those employed by the preceding embodiments, that is, the arrangement in which the magnetic flux generating member is disposed within the hollow of the heat generating member. In other words, the magnetic flux generating means may be disposed outside the heat generating member.

5) The preceding embodiments of the present invention, or the fixing apparatuses, were structured so that while an object to be heated (recording medium) was conveyed through the fixing apparatus, the center of the object remains aligned with the center of the fixation roller in terms of the lengthwise direction of the fixation roller. However, the present invention is also effectively applicable to a heating apparatus structured so that while an object to be heat is conveyed through the heating apparatus, one of the lateral edge of the object remains aligned with the positional referential portion of the apparatus.

6) The preceding embodiments the present invention in the form of a heating apparatus (fixing apparatus) were structured to accommodate two kinds of object to be heated (recording mediums) different in size, that is, an object of a large size and an object of a small size. However, the present invention is also applicable to a heating apparatus structured to accommodate three or more kinds of object to be heated (recording mediums).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308503/2004 filed Oct. 22, 2004 which is hereby incorporated by reference.

What is claimed is:

1. An image heating apparatus comprising:

a coil for generating a magnetic flux by electric power supply thereto;

an image heating member for heating an image on a recording material by heat generation using the magnetic flux generated by said coil;

magnetic flux adjusting means for adjusting a distribution of the magnetic flux directed from said coil toward said heat generation member in a direction perpendicular to a feeding direction of the recording material;

moving means for moving said magnetic flux adjusting means to a position for making smaller the magnetic flux directed from said coil toward said heat generation member at an end portion of said image heating member than at a middle portion;

switching means for switching a number of recording materials per unit time to reduce the number of the recording materials having a length, measured in the perpendicular direction, smaller than a maximum usable length as measured in the perpendicular direction; and operation control means for enabling an operation of said moving means during operation of said switching means.

2. An apparatus according to claim 1, further comprising a first temperature detecting member for detecting a temperature of said image heating member, temperature control means for controlling the electric power supply to said coil on the basis of an output of said first temperature detecting member, and a second temperature detecting member for detecting a temperature of said image heating member at a position different from a position at which said first temperature detecting member detects the temperature, wherein said moving means is operated on the basis of an output of second temperature detecting member.

3. An apparatus according to claim 1, wherein the number of the recording materials per unit time is reduced on the basis of the number of the recording materials during a continuous heating operations.

4. An apparatus according to claim 1, wherein said magnetic flux adjusting means includes a shield member for shielding the magnetic flux directed from said coil toward said image heating member.

* * * * *

UNITED STATES PATENT AND TRADEMARK OFFICE

CERTIFICATE OF CORRECTION

PATENT NO. : 7,205,514 B2
APPLICATION NO. : 11/254707
DATED : April 17, 2007
INVENTOR(S) : Hitoshi Suzuki et al.

It is certified that error appears in the above-identified patent and that said Letters Patent is hereby corrected as shown below:

ON THE TITLE PAGE
At Item (57), Abstract, line 12, “theat” should read --the heat--.

IN THE DRAWINGS
Sheet 5, Fig. 5, “FIXING ROLER TEMP.” should read --FIXING ROLLER TEMP.--.
Sheet 5, Fig. 6, “THROUGH PUT” (two occurrences) should read --THROUGHPUT--.
Sheet 8, Fig. 9, “THROUGH PUT” (two occurrences) should read --THROUGHPUT--, and “TMEP.” should read --TEMP.--.
Sheet 10, Fig. 11, “THROUGH PUT” (two occurrences) should read --THROUGHPUT--.
Sheet 12, Fig. 13, “THROUGH PUT” (two occurrences) should read --THROUGHPUT--.

COLUMN 2
Line 4, “remains” should read --remain--.
Line 12, “give” should read --given--.

COLUMN 3
Line 28, “occurs” should read --occur--.
Line 37, “occurs” should read --occur--.
Line 44, “occurs” should read --occur--.
Line 51, “occurs” should read --occur--.

COLUMN 6
Line 49, “small is” should read --small in--.

COLUMN 9
Line 23, “of s recording” should read --of a recording--.
Line 27, “symbols” should read --symbol--.
Line 43, “adjusts” should read --adjust--.

COLUMN 10
Line 18, “PW1,” should read --PW1',--.
Line 33, “making means,” should read --making means 22,--.

COLUMN 11
Line 7, “adjusting, member” should read --adjusting member--.
Line 19, “interferes” should read --interfere--.
Line 56, “PW2,” should read --PW2',--.

UNITED STATES PATENT AND TRADEMARK OFFICE

CERTIFICATE OF CORRECTION

PATENT NO. : 7,205,514 B2
APPLICATION NO. : 11/254707
DATED : April 17, 2007
INVENTOR(S) : Hitoshi Suzuki et al.

It is certified that error appears in the above-identified patent and that said Letters Patent is hereby corrected as shown below:

COLUMN 12
Line 55, “medium” should read --mediums--.

COLUMN 13
Line 31, “8 is moved” should read --8 moved--.

COLUMN 14
Line 45, “rises” should read --rise--.

COLUMN 15
Line 7, “increases” should read --increase--.
Line 19, “corresponding” should read --corresponding to--.

COLUMN 17
Line 12, “increases” should read --increase--.

COLUMN 18
Line 7, “correspond” should read --corresponds--.
Line 29, “a pager” should read --paper--.
Line 59, “to be heat” should read --to be heated--.
Line 61, “edge” should read --edges--.
Line 63, “embodiments” should read --embodiments of--.
Line 65, “object” should read --objects--.

UNITED STATES PATENT AND TRADEMARK OFFICE

CERTIFICATE OF CORRECTION

PATENT NO. : 7,205,514 B2
APPLICATION NO. : 11/254707
DATED : April 17, 2007
INVENTOR(S) : Hitoshi Suzuki et al.

It is certified that error appears in the above-identified patent and that said Letters Patent is hereby corrected as shown below:

COLUMN 19
Line 2, "object" should read --objects--.

COLUMN 20
Line 24, "operations." should read --operation.--.

Signed and Sealed this

Sixth Day of May, 2008

JON W. DUDAS
*Director of the United States Patent and Trademark Office*